US009073059B2

(12) United States Patent
Bozzato

(10) Patent No.: US 9,073,059 B2
(45) Date of Patent: Jul. 7, 2015

(54) METHOD AND APPARATUS FOR PARTICLE SEPARATION

(75) Inventor: Paolo Bozzato, Dellslow, WV (US)

(73) Assignee: Ecomin S.R.L., Genoa (GE) (IT)

( * ) Notice: Subject to any disclaimer, the term of this patent is extended or adjusted under 35 U.S.C. 154(b) by 0 days.

(21) Appl. No.: 14/114,171

(22) PCT Filed: Apr. 11, 2012

(86) PCT No.: PCT/IB2012/051765

§ 371 (c)(1),
(2), (4) Date: Oct. 25, 2013

(87) PCT Pub. No.: WO2012/146997

PCT Pub. Date: Nov. 1, 2012

(65) Prior Publication Data

US 2014/0091017 A1 Apr. 3, 2014

(30) Foreign Application Priority Data

Apr. 28, 2011 (IT) ..... GE2011A0049

(51) Int. Cl.

| | |
|---|---|
| ***B03B 5/28*** | (2006.01) |
| ***B03B 5/34*** | (2006.01) |
| ***B04C 5/26*** | (2006.01) |
| ***B04C 7/00*** | (2006.01) |
| ***B04C 11/00*** | (2006.01) |

(52) U.S. Cl.
CPC ... *B03B 5/34* (2013.01); *B04C 5/26* (2013.01); *B04C 7/00* (2013.01); *B04C 11/00* (2013.01)

(58) Field of Classification Search
USPC ..... 209/725, 728, 729; 210/512.2
See application file for complete search history.

(56) References Cited

U.S. PATENT DOCUMENTS 3,052,361 A * 9/1962 Whatley et al. ..... 210/512.2

FOREIGN PATENT DOCUMENTS

| | | | | |
|---|---|---|---|---|
| CN | 101 590 452 | A | 12/2009 | |
| EP | 1 126 076 | A2 | 8/2001 | |
| EP | 1126076 | A2 * | 8/2001 | ..... D21D 5/24 |
| FR | 1 253 230 | A | 2/1961 | |
| GB | 530309 | | 12/1940 | |
| GB | 542988 | | 2/1942 | |
| GB | 2 128 905 | A | 10/1982 | |
| GB | 2 164 589 | | 3/1986 | |
| IT | 1165494 | | 4/1987 | |
| IT | 1152915 | | 1/1989 | |
| WO | 86/06653 | A1 | 11/1986 | |

OTHER PUBLICATIONS

International Search Report and Written Opinion dated Aug. 24, 2012, issued in PCT Application No. PCT/IB2012/051765, filed Apr. 11, 2012.

* cited by examiner

*Primary Examiner* — Terrell Matthews
(74) *Attorney, Agent, or Firm* — Workman Nydegger

(57) ABSTRACT

The invention relates to the dynamic separation of particles such as those resulting from crushing and grinding extracted minerals or recycled materials (glass, plastic, etc.). The separation is carried out by multi-stage dynamic separators (2, 3), a regulation being carried out therebetween by feeding a fluid. This latter can be a dense medium similar to that feeding the stages, and can have a rotational component with respect to the axis of the separator.

9 Claims, 3 Drawing Sheets

Prior Art

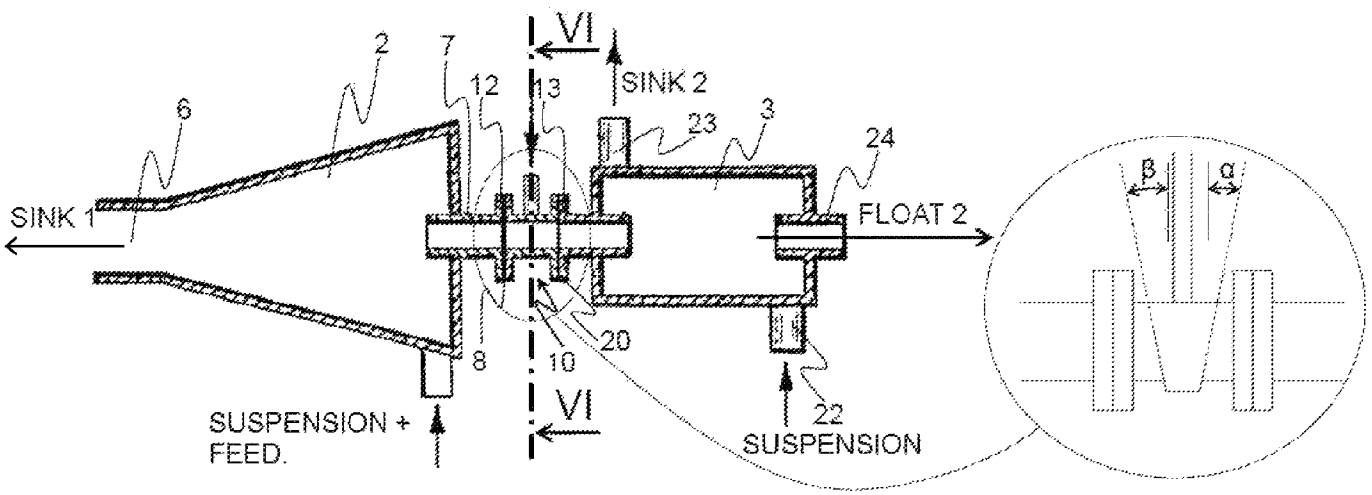
Fig. 5
Fig. 5a
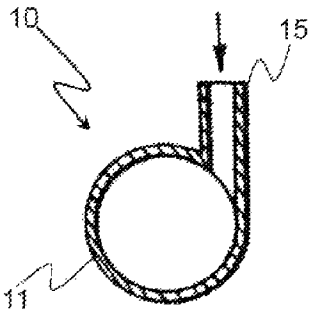
Fig. 6
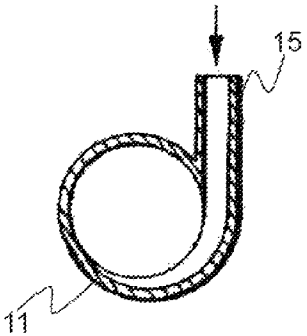
Fig. 6a
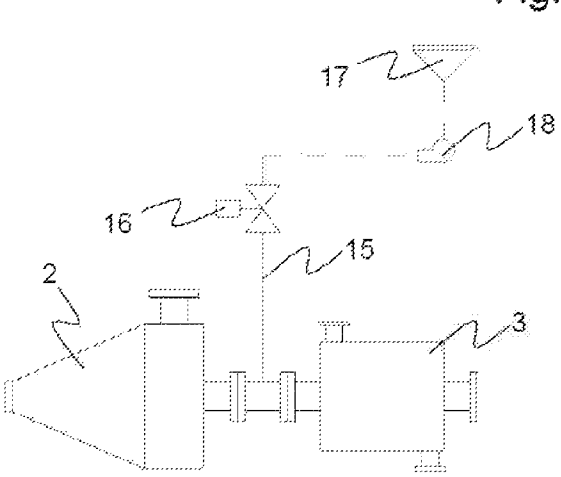
Fig. 7a
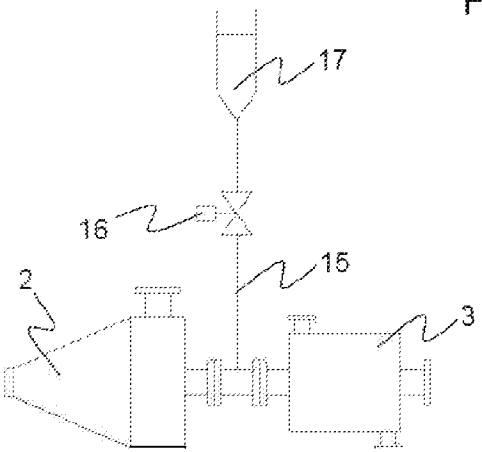
Fig. 7

METHOD AND APPARATUS FOR PARTICLE SEPARATION

BACKGROUND OF THE INVENTION

1. Field of the Invention

The present invention relates to a method and apparatus for particle separation.

2. Present State of the Art

The invention particularly relates to the separation applied in the mining, extracting field and the like, wherein the particles to be separated, obtained from minerals reduced to a predetermined size, are dispersed into a fluid fed to dynamic separators, both conical ones generally called as cyclones, and cylindrical ones or combinations of both shapes.

The latter are machines exploiting centrifugal forces that are generated by providing a rotational motion to a fluid containing the suspended particles, inside a chamber preferably having cylindrical or frustoconical geometry.

Thus the field of centrifugal forces generated into the (gaseous or liquid) fluid causes the particles to be arranged in layers with the same terminal velocity, which depends on the density, size, shape, etc., concentric to each other, thereby causing the particles with lower terminal velocity to float along the axis of the separator, and the particles with higher terminal velocity to sink by entraining them against the walls of the cylindrical or frustoconical shaped chamber.

In the mining industry, the separation cyclones are apparatus typically used for separating the extraction material, after crushing and grounding the minerals into granules of predetermined size.

Commonly called cyclone separators have mainly a frustoconical shape and are equipped with a tangentially arranged inlet duct and with two outlets along the axis of the separator. In particular a first outlet is arranged near the vertex of the cone and it is intended to discharge the fraction of heavier particles or more in general those having higher terminal velocity, while the second one is arranged at the base of the cone and serves for discharging the fraction of particles having lower terminal velocity.

Dynamic separators with a mainly cylindrical shape are usually used for a more accurate separation than cyclone ones. If the desired separation is mainly due to the density of the particles, a dense medium with a predetermined density is used; such separators can have, depending on needs, a preferably cylindrical or frustoconical shape. These apparatus are part of the prior art that has been established for many years.

The cyclone separators and the dynamic cylindrical ones mentioned above have been well-known since a long time and in order to improve their performances, the fact of arranging them in series one after the other (both conical and cylindrical separators) is also known to obtain multi-stage separation apparatuses.

Examples of such apparatuses are described in Italian and English patent publications IT 1152915 and GB 2 164 589, both to Prominco S.r.l.

The operating principle of multi-stage apparatuses is that by dividing the separation into several successive stages, it is possible to have for each one of them better conditions to remove the light fraction from the heavy one, since the probability increases that a particle be discharged into the e stream of which it is part.

Indeed as shown in FIG. 1 annexed hereto and taken from the already mentioned document GB 2 164 589, a single separation stage (curve A) is able to remove a smaller percentage (under equal conditions) of a material having a predetermined density, than that obtainable by increasing the number of separation stages (curves B,C,D): thus it is possible to increase the accuracy of the separation therefore enhancing the performance of the whole process.

A particularly interesting case is when a high quality coal is desired (density of 1.1-1.3 kg/dm$^3$).

There are cases when three or more by-products have to be divided (for example metallurgical coal, thermal coal and tailings) from a feeding material; to this end, it is also possible to advantageously use dense media with different densities in the several stages instead of using completely independent separation stages which are much expensive to be installed and operated, however making the connection with each other not favorable if the difference between the two media is very high (e.g. d1=2.00 kg/dm$^3$, d2=1.45 kg/dm$^3$). As a matter of fact, in this situation a difference in the density between the fluid entering the following downstream separator and its dense medium (e.g. i1=1.8 kg/dm$^3$, d2=1.45 kg/dm$^3$), would be generated, such that the separator would operate under not optimal working conditions at least in a part of the next stage of the separator, thus accomplishing a low quality separation or requiring the stage to be oversized.

As it can be noted, on one hand the use of a greater number of separation stages theoretically allows the performance of the separation process to be optimized (as regards the separation accuracy if only two products are separated or as regards the cheapness if three or more products are separated) on the other hand apparatuses are made more complicated which in practice means that they are functionally little flexible, since in order to keep in the several stages the design conditions for the separation it is not possible to make changes in one stage without affecting the following ones.

Consequently, if for any reasons should the conditions of the fluid (e.g. flow rate, density, etc.) with suspended particles change into a stage of the separator, even the other ones would be involved worsening the performances of the whole apparatus.

SUMMARY OF THE INVENTION

The technical problem that the present invention aims to solve is that of overcoming the drawbacks set forth above.

The idea for solving such problem is to provide a control of the separation process, which operates between one stage and another so that inside each one of them stable conditions are obtained thereby achieving an optimal operation.

The above mentioned technical problem is solved by a separation method according to the annexed claim 1.

The invention comprises also an apparatus for particle separation by means of said method, whose features are also set forth in the annexed claims.

BRIEF DESCRIPTION OF THE DRAWINGS

These features and further effects of the present invention will be more clear from the description of one embodiment thereof shown in the annexed drawings, provided merely by way of example and not limitation, wherein:

FIG. 5 is a simplified section view of the apparatus of the present invention;

FIG. 5*a* is an enlarged view of a possible variant of a detail of FIG. 5;

FIG. 6 is a section view taken along line VI-VI of FIG. 5, of a detail of the apparatus according to the invention;

FIG. 6*a* is a section view along line VI-VI of FIG. 5, of a variant of the detail of FIG. 6;

FIG. 7 is a part of a plant scheme where the apparatus of FIG. 5 is provided;

FIG. 7*a* is a variant of the plant scheme of the previous figure;

DETAILED DESCRIPTION OF THE PREFERRED EMBODIMENTS

Figure 2:
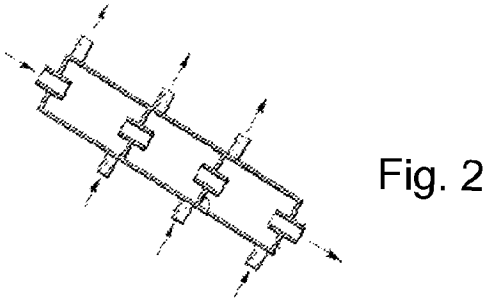
FIGS. 2-4 are section views of respective possible embodiments of separation apparatuses known from document GB 2 164 589.

With reference to the drawings listed above and in particular to FIGS. 5 to 10, different embodiments of the separation apparatus are shown according to the invention; in FIG. 5 the first of such embodiments is denoted as a whole by 1 and it comprises two separation stages, the first one of which is composed of a separation cyclone 2, while the second one is a cylindrical separator 3.

As both these types of separators are already known per se, in this description reference will be made only to the parts necessary for understanding the invention, relesing to existing technical, scientific and patent publications about the subject for more details; among such publications, in addition to the documents mentioned above (IT 1152915 and GB 2164589), also patent publications GB 530309 or GB 542988 are pointed out which relate to cyclone separators.

The separation apparatus 1 is particularly intended to treat materials deriving from mining extraction, crushed and ground such as to obtain particles with a predetermined size, or materials to be recycled such as plastic, glass, aluminum, etc.; the mining materials treated by the separator 1 can be coal or (ferrous and nonferrous) metals with different densities, mixed with other inert materials such as carbonates, silicates and so on.

The material is fed into the first cyclone separation stage as a suspension in a fluid that can be gaseous or liquid (preferably water), depending on applications and on the variants of the present invention; as it occurs in cyclone separators, heavier material is separated from lighter one dispersed into the suspension, and it goes out through an axial discharge duct 6. On the contrary the light fraction goes on in the apparatus 1 through an outlet manifold 7, which is preferably equipped with a flange 8 allowing it to be connected to an intermediate regulation body 10.

The regulation body 10 provides a central tubular part 11 having substantially the same diameter of the manifold 7 of the first separation stage, at which ends two flanges 12 and 13 are provided for the connection to the separation stages 2 and 3; a regulation channel 15 further enters the intermediate body, which is intended to supply a fluid into the separation apparatus 1.

The regulation channel 15 is preferably arranged tangentially with respect to the intermediate body 10 as it can be seen in FIGS. 6, 6*a* and 5*a*, which show respective embodiments of the channel 15; however other arrangements of the channel are possible, for example radial with respect to the separation body 10 or oriented in different manner (for example oblique) with respect thereto, with values of $\alpha$ and $\beta$ both negative and positive and null as shown in FIG. 5*a*.

The regulation channel 15 can be also subjected to several arrangements, for instance also its length can change depending on the needs of the separation process; some figures show only the end portion of the regulation channel 10 which however can extend upstream for conveying a process fluid into the separator.

To this end in FIGS. 7, 7*a* there are shown respective alternative solutions for feeding a regulation fluid through the corresponding channel 15 (this is a schematic representation of a plant where the separation apparatus 1 is introduced); the plant actually is much more complicated, as it can be noted from the embodiment described in patent IT11654948, whose contents is to be considered incorporated in the present application, since it is consistent therewith.

The regulation fluid can be fed by gravity or by pumping it; to this end, upstream the channel 15 there is provided a control valve 16 which allows the fluid from a tank 17 to be conveyed by gravity, or by a pressure supplied by a pump 18. The latter can be replaced by a compressor if the regulation fluid is gaseous.

The second separation stage 3 is, as already said, of the dynamic type and downstream the intermediate body 10 it is connected by a respective flange 20; the dynamic separator 3 has the usual mainly cylindrical shape and the fluid coming from the first stage 2 enters therein axially at the inlet duct 21, for meeting the process fluid (namely a dense medium) entering into the separator through the inlet 22 as denoted by arrows in FIG. 5.

The process fluid 22 is then discharged through an outlet manifold 23, together with the heavy fraction of the separated particles (called also as "sink" by people skilled in the art) while the lighter fraction (also called "float") of the material that axially moves forward, goes out along the same line in the outlet 24 downstream the separator.

The operation of the separator described herein before is as follows (FIG. 5).

The fluid with the suspended particles of mineral material to be separated is fed to the first stage 2, where a first separation of the particles having higher density (sink) takes place, which particles go out through the mouth 6 of the cone of the cyclone separator 2; the light fraction (float) advances into the outlet manifold 7 and it arrives at the regulation body 10, where the regulation channel 15 enters.

At the manifold 7 and/or regulation body 10 there is provided, preferably, even if optionally, a detector for the characteristics of the fluid coming from the cyclone separator, that below will be briefly called as "float 1" (i.e. related to the first separation stage); the detector of the characteristics of the fluid float 1 can be of a type known in se, for example optical, magnetic or other type (these density meters are available in Italy, marketed by companies Heinrichs, Trimtec Sistemi), and it is intended to make measurements directly on the fluid stream; on the contrary, the measurements can be made on samples of fluid extracted from the intermediate body 10 during the separation process, by means of redirections (bypass) not shown in the drawings. Another type of regulation can rely on the effects of the separation into the separator 3 such as on-line measurement of the ashes contained into the product coming out from the duct 24, or the desired element content, etc.

Depending on the measurement that has been made, the control system of the separator 1 operates the solenoid valve 16 which activates the supply and regulation of the regulation fluid through the channel 15 into the regulation body 10.

To this end, depending on process conditions, the fluid contained into the tank 17 can be water or an aqueous solution with particles of predetermined density such to regulate that of the fluid float 1 before it enters into the second separation stage 3.

In the second case the aqueous solution is preferably a suspension of magnetite and/or ferrosilicon with an appropriate concentration suitable for helping in separating the lighter fraction contained into the float 1, subsequently into the dynamic separator 2; the latter is the second separation stage, wherein the fluid is cut in order to divide the particles with lower density which are discharged through the outlet 24 by a stream that will be called for simplicity reasons as float 2 (namely related to second stage), from those with higher density which are discharged through the outlet 23 of the separator 3 (briefly as sink 2).

For this reason a dense medium is fed into the dynamic separator through the tangential inlet 22, which is also preferably composed of an aqueous solution of magnetite and/or ferrosilicon with a density generally intermediate between that of lighter particles of the stream (float 2) and heavier ones (sink 2) discharged from outlet 23.

Considering the description made up to now it is possible to understand how the separation method and the relevant separation apparatus for carrying out thereof, allow the technical problem underlying the invention to be solved.

The regulation made between one stage and the other of the separator, by the controlled feeding of the regulation fluid through channel 15, allows process conditions at the entrance of the second stage 3 to be accurately regulated, thereby keeping therein the optimal conditions for the dynamic separation; this results is achieved without making changes to the operation of the first stage, which therefore can operate as usual.

It is clear that by suitably regulating the valve 16 and/or the number of revolutions per minute of the motor of the pump 18, it is possible to regulate the flow rate of the control fluid which is added to the process one, between the two separation stages 2 and 3.

The resulting density of the fluid entering the second separator will be a weighted mean of the densities of the two fluids (partially separated fluid and control dense medium), by using the two volumetric flow rates as the weights.

This makes the application of the present invention particularly advantageous for already existing separation plants, since the changes to be made affect only the intermediate area connecting the stages arranged in series.

The invention is also intended to be applied in single stage separation plant, which can be transformed into multi-stage plants by adding one or more stages in series (both frusto-conical shaped and mainly cylindrical ones), whose operation can be made as optimal due to the intermediate regulation according to the teaching described above.

This allows performances to be enhanced, and, as already said, a better separation to be obtained both as regards the quality and quantity point of view.

The output of the product (float 2) coming out from the second stage 3 has a high content of the lighter fraction of particles, with a consequent higher performance of the whole process; it has to be noted that as regards costs this result can be advantageously obtained, by using as the dense medium for the separation stage 3 a fluid like that used for feeding the cyclone separator 2 of the first stage.

Figure 8:
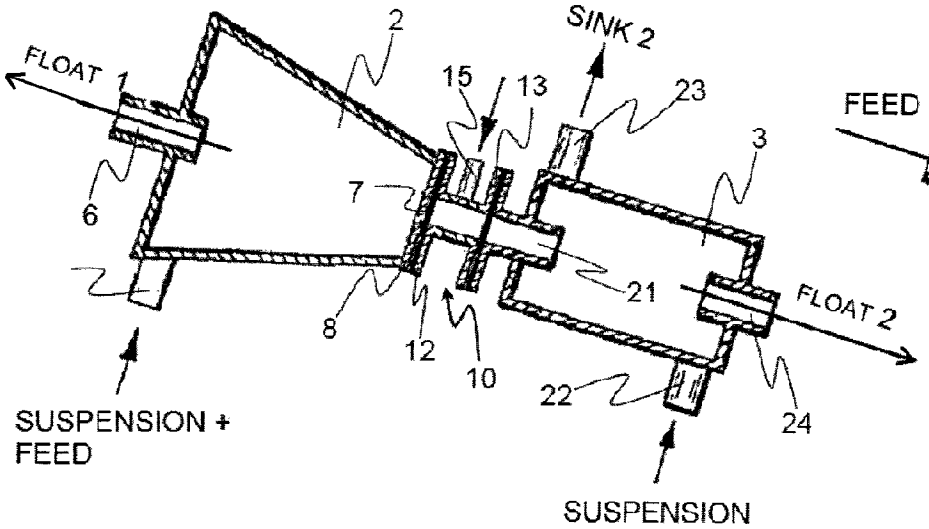
Figure 10:
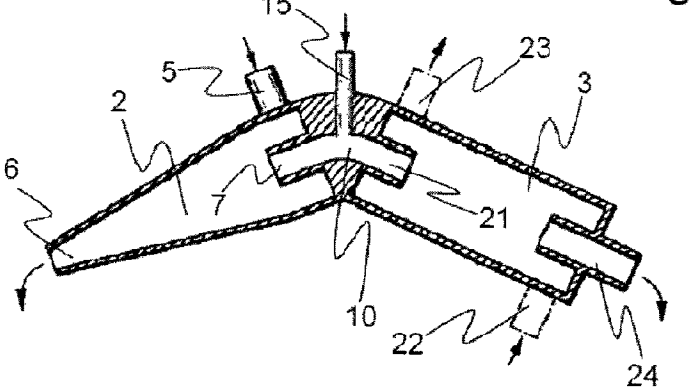

Obviously variants of the invention are possible with respect to the example described up to now, which will be considered with reference to FIG. 8 and following ones, which show respective alternative embodiments where for simplicity reasons the same reference numerals will be used for denoting, where possible, structurally or functionally equivalent parts.

The variant in FIG. 8 is different from the previous one in that in the first cyclone separation stage 2 the taper is arranged in an inverted manner, such that the heavier fraction (sink) of the suspension fed therein is separated and sent to the second separation stage 3, after passing into the intermediate body 10 where the regulation of the characteristics is made, according to what already explained above.

In this variant, the second stage 3 is composed of a dynamic separator completely similar to the previous case, and therefore its operation and the relevant advantages achieved are those already explained above.

However it can be understood that since the arrangement of the cyclone separator 2 has been inverted, such that the heavier fraction of particles (sink) that are separated is discharged and sent to the second separation stage 3, the regulation in the intermediate body 10 can be made with fluids having features different than the first embodiment, other conditions being equal.

Figure 9:
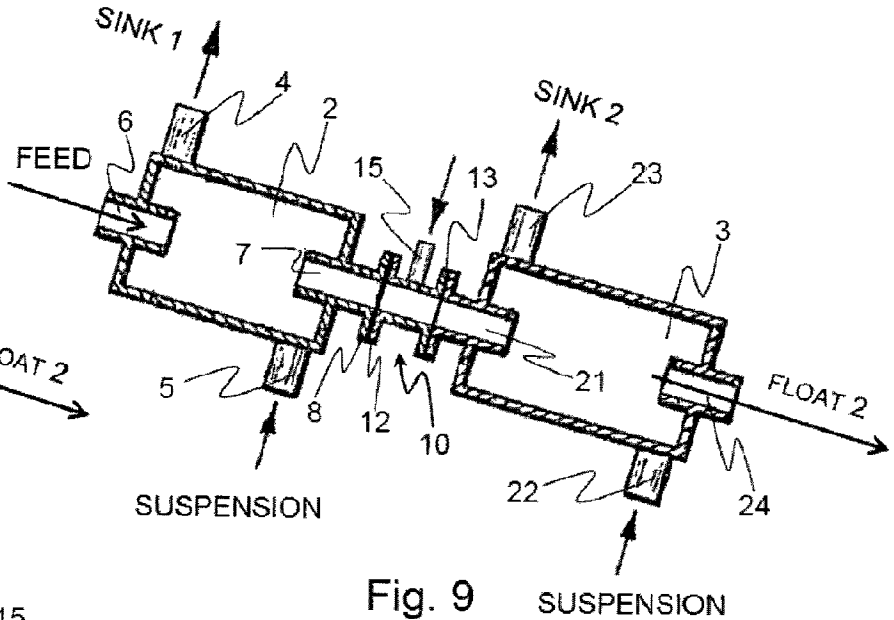
FIGS. 8, 9 and 10 are respective variant embodiments of the apparatus according to the invention. It is important to notice that in FIG. 8 the heavy material is re-processed instead of the light material of the first stage unlike all the other shown figures, to this end, only in FIG. 8 the duct 6 is the outlet for the light material and the duct 7 is the outlet for the heavy material.

As a further variant of the invention it has to be pointed out that the separators usable for the invention have not to be necessarily different one another, namely of the cyclone and dynamic type as in the first two cases, but they can be two (o more) equal separators such as shown in FIG. 9.

Even if in this last figure for the first stage 2 the same reference numerals are used as those used for the cyclone separator, it is clear that it is a dynamic separator equipped with a tangential inlet 5 for the dense medium, and however even in this case the regulation between one stage and another one of the fluid float 1 coming out form the first stage occurs according to the teaching already set forth, with the relevant effects deriving therefrom.

As it can be understood, the present invention has the important advantage of being functionally flexible and therefore applicable to different arrangements of the separator; as it can be noted from figures, in the first example the axis of the separator is horizontally arranged, while in FIGS. 8 and 9 the separator is arranged with the axis inclined. However this is not binding and it will be possible to have different arrangements, where the first and second stages have different respective axes of inclination as in FIG. 10, where the first stage is a cyclone separator, while the second one is a cylindrical separator.

Even as regards the regulations made by supplying a fluid into the intermediate body 10, several variants are possible.

The composition of such fluid can be studied depending on applications; therefore it will be possible to have a fluid as simple water or aqueous solutions containing particles even different than those present into the separators, or an aqueous solution instead of a suspension, or a mixture of gas finely distributed into a liquid, etc.

Also with reference to the parameters for introducing the regulation fluid through channel 15 such as pressure, velocity, quantity, they will be defined depending on the separation process to be made.

This is advantageous when the fluid composition into the separation stages 2, 3 changes, for instance when the composition of the material particles changes.

It is however clear that several inlet channels 15 can be provided between the separation stages, instead of the single one shown in the drawings; such channels can be arranged in different locations along the intermediate body 10, in order to allow the regulation fluid to be introduced in separate points in the fluid mass flowing therein.

It has to be further noticed that the tangential arrangement of the channel 15 at one side or at the opposite one of the intermediate body 10, helps in exerting a rotational clockwise or counter clockwise component to the fluid fed therein.

Figure 3:
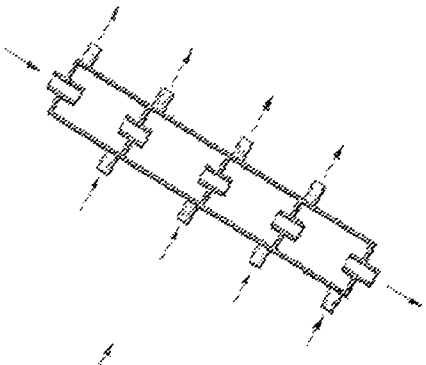
Figure 4:
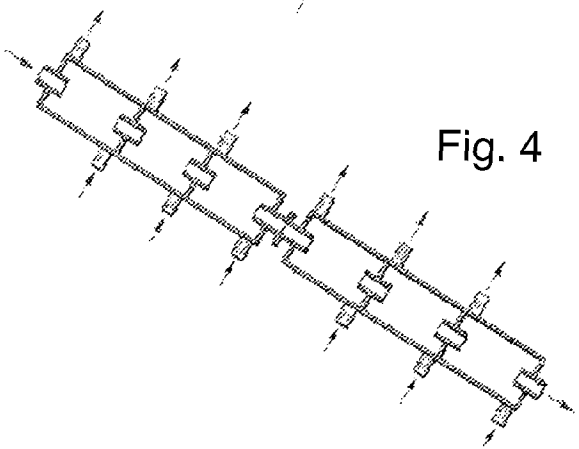
Figure 1:
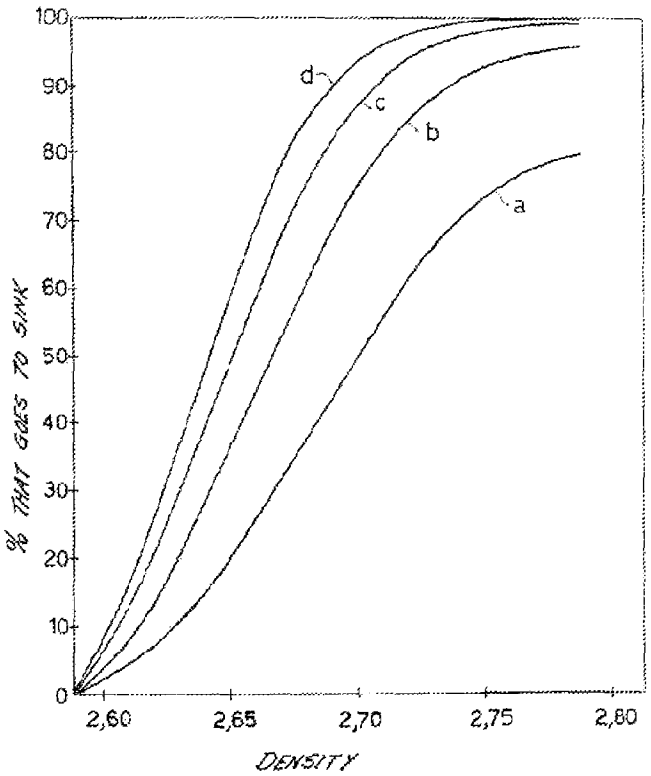
FIG. 1 is a graph showing the interpolation of data about the percentage of heavy fraction of the fluid separated as a function of the density of a known multi-stage separator.

Finally it is important to point out that the invention applies to apparatuses with a number of stages higher than two, such as those known shown in FIGS. 2, 3 and 4.

Particularly, it will be possible to insert a regulation channel between one stage and the next one, such to have apparatuses with 2, 3 or more regulation channels in proportion to the number of stages.

But it will be possible also to have groups of separation stages such as those shown in FIG. 4, with one (or more) regulation channel applied therebetween according to the teaching of the previous examples.

With reference to FIG. 4, it is clear that an intermediate body such as that denoted by 10 in FIGS. 5-10 can be inserted between the flanges connecting the groups of separators, such that the process can be regulated as already explained.

Finally it has to be pointed out that the principles of the invention can be applied even to fluids, of the gaseous type, into which particles to be separated are dispersed.

Other combinations among the variants described herein are possible, however without departing from the teaching of the present invention.

The invention claimed is:

1. A method for particle separation, wherein a fluid with particles dispersed therein is subjected to a centrifugal action in at least two successive stages in order to separate particles having a different terminal velocity, comprising:

carrying out a regulation step in an intermediate position between the stages, wherein the fluid coming from a first stage enters a second stage axially, wherein the regulation step comprises introducing a regulation fluid between said at least two stages; and wherein the introduction of the regulation fluid includes providing a rotational velocity component to the regulation fluid.

2. The method according to claim 1, wherein the regulation fluid contains particles similar to those to be separated.

3. The method according to claim 1, wherein the fluid containing the particles to be separated and the regulation fluid are water-based liquids.

4. An apparatus for particle separation, comprising:

at least two stages wherein a fluid with particles dispersed therein is subjected to a centrifugal action in order to separate particles having a different terminal velocity, an operating regulation means in an intermediate position between the stages wherein the regulation means comprises:

a channel for introducing a regulation fluid at an intermediate location between the separation stages; and an intermediate body extending between the separation stages, wherein the regulation channel enters the intermediate body tangentially with respect to the intermediate body.

5. The apparatus according to claim 4, wherein the separation stages are cyclone separators or separators having mainly a cylindrical shape.

6. The apparatus according to claim 4, wherein the regulation channel is oriented with respect to the intermediate body with an inclination angle that is negative, positive or null with reference to a radial direction of the intermediate body.

7. The apparatus according claim 4, wherein the second stage is of the dynamic type.

8. The apparatus according claim 5, wherein the second stage is of the dynamic type.

9. The apparatus according claim 6, wherein the second stage is of the dynamic type.

* * * * *